United States Patent [19]

Miller

[11] 4,365,785

[45] Dec. 28, 1982

[54] ROCKER-ARM HAVING PERPENDICULAR GEOMETRY AT VALVE MID-LIFT

[76] Inventor: James M. Miller, 1688 Indiana Dr., Galesburg, Ill. 61401

[21] Appl. No.: 211,638

[22] Filed: Dec. 1, 1980

[51] Int. Cl.[3] ..... F01L 1/18; F16K 31/44

[52] U.S. Cl. ..... 251/231; 123/90.39; 123/90.45; 74/519; 74/522

[58] Field of Search ..... 74/519, 522; 123/90.39, 123/90.41, 90.45; 251/231, 234

[56] References Cited

U.S. PATENT DOCUMENTS

| | | | |
|---|---|---|---|
| 3,066,659 | 12/1962 | Colton | 123/90.39 |
| 3,251,350 | 5/1966 | Thompson | 123/90.41 |
| 3,466,073 | 9/1969 | Pohle | 123/90.39 |
| 4,182,290 | 1/1980 | Pohle | 123/90.39 |
| 4,187,810 | 2/1980 | Buehner | 123/90.39 |

FOREIGN PATENT DOCUMENTS

| | | | |
|---|---|---|---|
| 666675 | 2/1952 | United Kingdom | 123/90.41 |

*Primary Examiner*—George L. Walton

[57] ABSTRACT

Roller-tip rocker-arm for high-performance internal combustion engines, pivotable about a trunnion therethrough, having a roller in the tip thereof for contacting the stem of a valve depressed (i.e., in the engine, per se, "lifted" from its seat in the "closed" position) thereby and having on the other end (i.e., tail) thereof an arcuate surface for contacting and abutting the cooperatively shaped end of a pushrod, the latter of which lifts said tail, wherein the roller and arcuate surface are so positioned so that, at the point in the motion of the rocker-arm wherein the valve stem is at a location corresponding to the mid-lift of the valve to which it is attached, the angles (a) that the axis of the valve stem defines with the axis intersecting the axes of the roller and trunnion and (b) that the axis of the pushrod defines with the axis intersecting the center of the arcuate surface and the axis of the trunnion are both essentially 90 degrees.

Such geometry eliminates the under-arcing and/or over-arcing of the roller-tip and/or pushrod characteristic of conventional rocker-arm operation and advantageously allows significantly improved engine performance.

Optional means are provided on the rocker-arm to allow maximum accuracy in adjusting the position of rocker-arm mounting in the engine.

16 Claims, 4 Drawing Figures

ROCKER-ARM HAVING PERPENDICULAR GEOMETRY AT VALVE MID-LIFT

BACKGROUND OF THE INVENTION

This invention relates to a roller-tip, rocker-arm for internal combustion engines, and, more particularly, to such a rocker-arm having a special perpendicular geometry at valve mid-lift to improve engine performance.

In internal combustion engines it is conventional to provide valves, for the fuel-intake and combustion gas-outlet ports of the engines' combustion cylinders, which are spring-biased to seat and close the respective ports and have upwardly extending stems that, through pivotally mounted rocker-arms contacting and abutting the respective ends of each, are caused to be depressed by the controlled upward movement of cam-driven push-rods, the rocker-arms being provided with trunnions, about which the rocker-arms pivot, mounted on the engine by stud elements that extend upwardly through the rocker-arm and trunnion combinations. By means of such an arrangement, the position or amount of "lift" being imparted to a given valve, at a particular time in the operation of the engine, by its respective pushrod and rocker-arm depends upon the shape of the cam lobe, on the cam shaft operating the valve system, allocated for that valve. Since the end of the rocker-arm contacting the valve stem (i.e., the "nose" of the arm) and the end thereof contacting the pushrod (i.e., the "tail" of the arm) each is a fixed distance from the trunion axis about which the arm pivots during its movement, in the operation of such a valve system there necessarily is some under-arcing and/or over-arcing of the arm nose and tail during engine operation, resulting in frictional contact between the abutting surfaces, particularly at the arm nose and spring-biased stem contact, that unsatisfactorily contributes to component wear and even failure, but, at a minimum, to loss of engine performance. Such problems become more aggravated in high performance, high r.p.m. engines, such as those employed in drag racing. Trans-Am competition, boat racing, and other motorsports competition, due to the attendant increased reciprocation of the rocker-arm and also due to the use of stronger springs and sharper valve cam lobe shape changes demanded by such engines.

In an attempt to minimize such difficulties, various approaches have been suggested previously, including the location of a roller at the nose of the rocker-arm, exemplified by that shown in U.S. Pat. No. 3,466,073, and the use of particular alloys in the components, which are more expensive.

Such prior attempts, however, have not proven to be completely successful, since, due to apparent misassumptions regarding arm design consequences and an apparent desire to try to adapt "stock" rocker-arms to variously sized engines, little or nothing has been done to remedy the over-arcing problem, with the result that conventional rocker-arms remain to be characterized by motion of the arm nose and/or pushrod which exceeds the ideal (i.e., minimum) by levels ranging up to and over 30% and even as high as several hundred percent. Furthermore, the substitution of certain "stronger" alloys has also introduced more flexibility into the arm; so, such prior proposals have continued to be plagued by component wear and fracture problems and additional engine performance limitations such as premature valve float. Similarly, since such previous suggestions have failed to provide a suitable solution to the difficulties now traceable to the over-arcing characteristic, no discernible effort has been made heretofore to decrease the length of the pushrod side of the arm relative to the length of the valve side, under optimum arcing conditions, and others have been forced to retain the utilization of pushrod cams having relatively sharp lobe shapes which contribute to significantly high lifter motion, pushrod motion, and lifter violence and limited valve acceleration.

Accordingly, a search has continued in the art for an improved rocker-arm which can allow improved engine performance.

OBJECTS OF THE PRESENT INVENTION

Hence, the primary object of the present invention is to provide an improved rocker-arm.

Another object of the present invention is to provide an improved rocker-arm which advantageously reduces engine component wear and failures as compared to conventional rocker-arms.

An additional object of the present invention is to provide a novel rocker-arm which advantageously contributes to improved engine performance as compared to conventional rocker-arms.

A further object of the present invention is to provide a novel rocker-arm which advantageously is capable of utilization with pushrod cams of lower, gentler lobes to allow a reduction of lifter motion, pushrod motion, lifter violence and an increase in valve acceleration.

Still another object of the present invention is to provide a novel rocker-arm which advantageously allows significantly improved engine performance and is adapted with a feature which facilitates proper and accurate installation of the arm.

DESCRIPTION OF ACCOMPANYING DRAWINGS

The above objects are achieved and are features of the rocker-arm of the present invention which shall be described hereinbelow in detail with particular reference being made to the accompanying drawings of which:

DESCRIPTION OF SPECIFIC EMBODIMENTS

Figure 1:
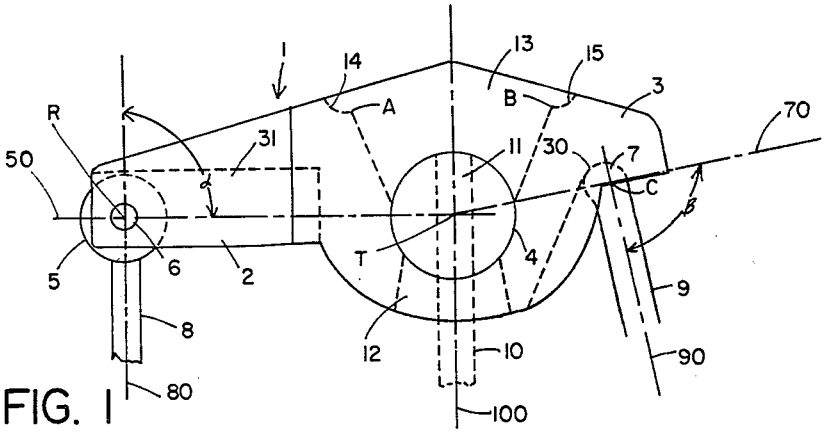
FIG. 1 is a diagrammatic side view of an embodiment of the roller-tip rocker-arm of the present invention, showing the arm in combination with its mounting stud and a valve stem and pushrod.

With reference to the accompanying drawings in which like numerals refer to like components, in FIG. 1 numeral one generally designates a rocker-arm of the present invention, which has a nose portion 2 and a tail portion 3 and which is adapted for pivotal movement about a horizontal axis T'-T" of a trunnion 4 mounted in the body of arm 1 intermediate nose 2 and tail 3 thereof. Arm 1 is provided with a cut-out portion 12 in the bottom thereof and a cut-out portion 13 in the top thereof, and trunnion 4 is provided with an opening 11 extending vertically therethrough so that, in the resultant openings, a stud 10 is adapted to be received and fixed by a conventional attachment means (e.g., a screw), not shown, to mount and anchor trunnion 4 to the engine on which the assembly is employed, so that arm 1 may "rock" about trunnion axis T'-T".

Nose portion 2 of arm 1 is provided with a longitudinally extending recess 31 which extends inwardly from the terminus thereof and in which is mounted, preferably through a bearing axle 6, a roller tip 5 having a horizontal axis R'-R" passing through its center R parallel to trunnion axis T'-T", with roller center R intersecting an axis 50 that is perpendicular thereto and passes through trunnion center T located on axis 100 of stud 10.

Tail portion of arm 1 has provided thereon, spaced from trunnion 4, an arcuate contact surface having a center C which intersects an axis 70 that is perpendicular to trunnion axis T'-T" and passes through trunion center T on stud axis 100.

Figure 2:
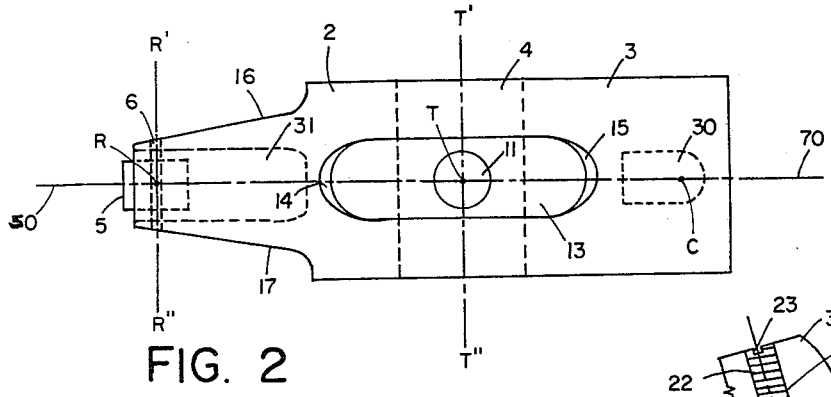
FIG. 2 is a diagrammatic top view of the embodiment of the rocker-arm of the invention shown in FIG. 1, with the stud, valve stem and pushrod elements being omitted.
Figure 3:
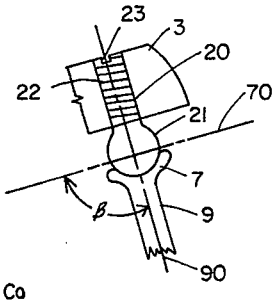
FIG. 3 is a diagrammatic side view (partial) illustrating an alternative construction of the pushrod side of the rocker-arm of the present invention.

The arcuate surface on tail 3 of arm 1 is of such a shape and size that it is adapted to contact and abut in a "seating" engagement therebetween a cooperatively sized and reversed arcuate-shaped end 7 of a pushrod 9 having an axis 90 that may intersect arcuate center C. Arcuate surface for abutting pushrod 9 suitably may be convex, i.e., such as is provided by a depressed cup 30 formed in the underside of tail 3, as shown in FIGS. 1 and 2, or may be concave, i.e., such as in the form of a ball element 21 located on the underside of tail 3, as shown in FIG. 3, with the cooperating abutting end 7 of pushrod 9 being concave, i.e., domed, and convex, i.e., cupped, respectively, as shown in the aforementioned respective Figures.

In general, the rocker-arm 1 of the present invention functions in a conventional manner. Being mounted on stud 10, arm 1 is adapted to rotate or "rock" about trunnion 4 and about trunnion axis T'-T", with roller 5 being adapted to contact and abut the end 8 of a valve stem of a valve, not shown, during the length of travel of said stem. The valve is of conventional design, having a spring, not shown, that biases the valve toward its seat in the engine, or its "closed" position. In the present rocker-arm, the center R of roller 5 is adapted to intersect with axis 80 of valve stem 8. At the tail 3 of arm 1 the arcuate surface thereon, above described, is adapted to contact and abut, in seating engagement, the end 7 of pushrod 9 as pushrod 9 is caused to travel under the influence of a cam lobe on a cam shaft, not shown, allocated therefor, so that when tail 3 of arm 1 is lifted by pushrod 9 such action causes roller 5 to be depressed, which, in turn, effects a depression or lifting of the valve from its seat in the engine toward and to its "open" position.

Figure 4:
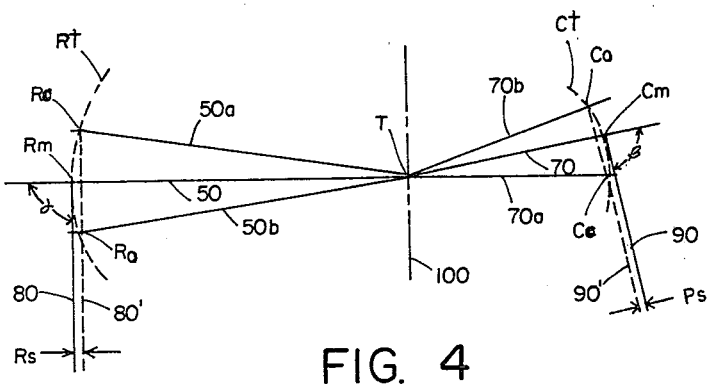
FIG. 4 is a schematic view illustrating the motion of the rocker-arm of the present invention.

The resultant motion of the arm components is schematically represented in FIG. 4, which shows that roller center R and arcuate surface center C, during the movement of the valve and the corresponding movement of arm 1, travel through arc paths Rt and Ct, are at points Rc and Cc when the valve is closed, are at points Ro and Co when the valve is open, and are at points Rm and Cm when the valve is at mid-lift position.

In accordance with the present invention, roller 5 and the arcuate surface on tail 3, represented by cup 30 or ball element 21, for example, are so positioned that, at the point wherein said valve is lifted one-half of the distance the same is to be lifted from its seat in the engine by the motion of arm 1 (i.e., at the mid-lift position), that is, when roller center R and arcuate surface center C are at points Rm and Cm, respectively, axis 80 of valve stem 8 intersects with axis 50 and axis 90 of pushrod 9 intersects axis 70, with the respective angles $\alpha$ and $\beta$ thereby being defined therebetween, as shown in FIGS. 1 and 4, being both essentially 90 degrees, more usually at least in the range of from about 85 to about 95 degrees, preferably in the range of from about 88 to about 92 degrees, and more preferably specifically 90 degrees.

By means of the perpendicular geometry of the rocker-arm 1 at the mid-lift position, the excess motion of rocker center R and the pushrod axis, i.e., Rs and Ps, as shown in FIG. 4, is maintained at a minimum, which advantageously reduces component wear and breakage and allows improved engine performance, e.g., reduces or eliminates premature valve float, even in the case of rocker-arms produced from relatively inexpensive alloys. Such geometry further advantageously allows the effective length of tail 3, relative to the effective length of nose 2, of arm to be decreased, i.e., provide arm 1 with increased ratios of distance RT/distance CT (distance of roller center R to trunnion center T/distance of arcuate center C to trunnion center T) as compared to conventional rocker-arm designs, e.g., to such ratios ranging up to and over at least 1.80:1, and even over at least 1.9:1. Such increased ratios advantageously allow the utilization of pushrod cams having cam lobes of lower, gentler shapes which result in a reduction of lifter motion, pushrod motion, lifter violence and an increase in valve acceleration, all further contributing to improved engine performance so sought after in high-performance engines.

As should be apparent from the hereinabove, in the actual use of arm 1, it is imperative that the arcuate surface on tail 3 abut end 7 of pushrod 9 at the proper points in the travel of pushrod 9. Thus, in actual practice proper positioning of arm 1 relative to pushrod end 7 often may require some vertical adjustment of one or both of such abutting members. Obviously, one approach available to achieve the proper positioning is to select or tailor a pushrod of the required length for a given arm design.

In accordance with the present invention, it is also contemplated to provide means for varying or adjusting the relative vertical position of the arcuate surface with respect to the body of tail 3 to achieve the desired abutting locationing. The arcuate surface, i.e., ball element 21, may be positioned on the end of a rod element 20, as shown in FIG. 3, threadedly and rotatably mounted within tail 3, as at 22, with rod element 20 being provided with means for rotating same, e.g., slotted head 23, whereby rod element 20 is adapted to be rotated to vary and adjust the relative vertical positioning of the arcuate surface, as desired, so that the required abutting positioning at mid-lift is obtained.

The preferred embodiments of the rocker-arms of the present invention are further provided with means which enable and greatly facilitate proper positioning of arm 1 and its arcuate surface relative to pushrod 9. In this respect, in such embodiments are provided, in opening 13 in the top of arm 1 for accomodating for the movement of stud 10 (and its adjusting screw or other conventional adjusting means, not shown), a pair of notches 14 and 15, forming shoulder means A and B, respectively, as shown in FIGS. 1 and 2, spaced apart 180 degrees centrally of arm 1, with each of shoulders A and B being equidistant, with arcuate surface center C, from trunnion center T. With the arm 1 in place, this feature allows a distance measuring means, e.g., a wire feeler gauge, to be inserted between the stud 10 and shoulder A or B, with the engine being adjusted to be in the valve "open" position, to determine the distance thereby resulting, and, after moving the engine to the valve "closed" position, to be inserted between stud 10 and the other shoulder to determine that distance obtaining. If the resulting distances are not equal, one-half the difference therebetween is the exact distance the abutment of arcuate surface and pushrod end 7 need be raised or lowered at mid-lift by adjusting either or both of the arcuate surface and pushrod effective lengths, as above-described.

While it will be understood that the above-described advantages are achieved in rocker-arms designed according to the present invention, regardless of the material from which the arm are formed, in accordance with the present invention, the more preferred arm are formed having bodies of forged Alluminum Alloy No. 7075T6, due to arms being fromed from the same having superior rigidity and strength and providing maximum improvement in engine performance.

What is claimed is:

1. In a roller-tip rocker-arm for moving a valve of an internal combustion engine, wherein said rocker-arm is adapted for pivotal movement about a horizontal axis of a trunnion mounted in the body of said rocker-arm, said rocker-arm has on a nose portion thereof, spaced from said trunnion, a rotatable horizontal roller having an axis parallel to said axis of said trunnion, said roller being adapted to contact and abut the end of a stem of a valve during the length of travel of said valve stem, with a valve to which said stem is connected being lifted from a seat therefor when said stem is depressed by said roller, and said rocker-arm has on a tail portion thereof, spaced from said trunnion and removed from said roller side of said arm, an arcuate surface adapted to contact and abut the cooperatively shaped end of a pushrod, which reciprocates along a fixed given axis with said tail of said rocker-arm being lifted by said pushrod, which, in turn, causes said roller to depress said valve stem, during the length of upward travel of said pushrod, the improvement comprising:

positioning said roller and arcuate surface so that, at the point wherein said valve is lifted one-half of the total length of travel of the valve stem from its valve seat by the motion of said rocker-arm, (a) the axis of said valve stem defines an angle of essentially 90 degrees with an axis intersecting said axes of said roller and trunnion, (b) the axis of said end of said pushrod defines an angle of essentially 90 degrees with an axis intersecting said trunnion and the center of said arcuate surface, and (c) means for adjusting said rocker-arm to simultaneously maintain the essentially 90 degree angles $\alpha$ and $\beta$ at the one-half valve lift point.

2. The rocker-arm according to claim 1 wherein angles $\alpha$ and $\beta$ which is essentially 90 degree angles are in the range of from about 85 to about 95 degrees.

3. The rocker-arm according to claim 1 wherein said angles $\alpha$ and $\beta$ are in the range of from about 88 to about 92 degrees.

4. The rocker-arm according to claim 1 wherein said arcuate surface on said tail of said arm is in the form of a depressed cup provided on the underside of said tail, with said cup being adapted to receive and communicate with a domed head of corresponding size and shape provided on said abutting end of said pushrod.

5. The rocker-arm according to claim 1 wherein said arcuate surface on said tail of said arm is in the form of a ball element located on the underside of said tail, with said ball element being adapted to be received and communicate with a cupped head of corresponding size and shape provided on said abutting end of said pushrod.

6. The rocker-arm according to claim 1 wherein said arcuate surface is positioned on the end of a rod element threadedly and rotatably positioned within said tail of said arm, whereby the vertical positioning of said arcuate surface relative to said tail of said arm and the end of said pushrod is adapted to be varied consistent with providing said angles $\alpha$ and $\beta$.

7. The rocker-arm according to claim 6 wherein said arcuate surface is a cup.

8. The rocker-arm according to claim 6 wherein said arcuate surface is a ball element.

9. The rocker-arm according to claim 1 wherein a ratio of the distance between said axes of said roller and said trunnion to the distance between said axes of said arcuate surface and said trunnion is at least about 1.8:1.

10. In a roller-tip rocker-arm for moving a valve of an internal combustion engine, wherein said rocker-arm is adapted for pivotal movement about a horizontal axis of a trunnion mounted in the body of said rocker-arm, said rocker-arm has on a nose portion thereof, spaced from said trunnion, a rotatable horizontal roller having an axis parallel to said axis of said trunnion, said roller being adapted to contact and abut the end of a stem of a valve during the length of travel of said valve stem, with a valve to which said stem is connected being lifted from a seat therefor when said stem is depressed by said roller, and said rocker-arm has on a tail portion thereof, spaced from said trunnion and removed from said roller side of said arm, an arcuate surface adapted to contact and abut the cooperatively shaped end of a pushrod, with said tail of said rocker-arm being lifted by said pushrod, which, in turn, causes said roller to depress said valve stem, during the length of upward travel of said pushrod, the improvement comprising:

positioning said roller and arcuate surface so that, at the point wherein said valve is lifted one-half of the total length of travel of said valve stem from its valve seat by the motion of said rocker-arm, (a) The axis of said end of said valve stem defines an angle of essentially 90 degrees with an axis intersecting said axes of said roller and trunnion, and (b) the axis of said end of said pushrod defines an angle of essentially 90 degrees with an axis intersecting said axes of said trunnion and the center of said arcuate surface, and further wherein said rocker-arm and said trunion each are provided with openings extending through the same from the top to the bottom thereof for receiving an upwardly extending stud element upon which said rocker-arm is normally mounted in said engine and wherein said rocker-arm, in the opening through the top thereof, is provided with a pair of notches, forming shoulder means, spaced apart 180 degrees centrally of said rocker-arm and located one toward said roller and one toward said arcuate surface, each of said shoulder means being equidistant, with said center of said arcuate surface, from said axis of said trunion, whereby said shoulders of said notches provide means from which measurements may be taken, with a wire guage, to equalize the respective spaces between said stud and said shoulders when said valve is at said one-half valve lift point and thereby provide means for adjusting the relative position of said pushrod and arcuate surface consistent with providing angles $\alpha$ and $\beta$ which is said essentially 90 degree angles.

11. The rocker-arm according to claim 9 wherein said arcuate surface is one positioned on the end of a rod element threadedly and rotatably positioned within said tail of said arm, whereby the vertical positioning of said arcuate surface relative to said tail of said arm and the end of said pushrod is adapted to be varied consistent with providing said angles $\alpha$ and $\beta$.

12. The rocker-arm according to claim 10 wherein said angles $\alpha$ and $\beta$ are in the range of from 85 to about 95 degrees.

13. The rocker-arm according to claim 10 wherein said angles $\alpha$ and $\beta$ are in the range of from about 88 to about 92 degrees.

14. The rocker-arm according to claim 10 wherein said arcuate surface on said tail of said arm is in the form of a depressed cup provided on the underside of said tail, with said cup being adapted to receive and communicate with a domed head of corresponding size and shape provided on said abutting end of said pushrod.

15. The rocker-arm according to claim 10 wherein said arcuate surface on said tail of said arm is in the form of a ball element located on the underside of said tail, with said ball element being adapted to be received and communicate with a supped head of corresponding size and shape provided on said abutting end of said pushrod.

16. The rocker-arm according to claim 10 wherein a ratio of the distance between said axes of said roller and said trunnion to the distance between said axes of said arcuate surface and said trunnion is at least about 1.8:1.

* * * * *